United States Patent [19]

Nakano et al.

[11] 4,384,520

[45] May 24, 1983

[54] DEVICE FOR CONTROLLING SOLENOIDS OF HIGH SPEED PRINTER

[75] Inventors: Hiroshige Nakano, Katsuta; Kensei Hosoya, Naka, both of Japan

[73] Assignee: Hitachi Koki Company, Limited, Katsuta, Japan

[21] Appl. No.: 300,539

[22] Filed: Sep. 9, 1981

[30] Foreign Application Priority Data

Sep. 16, 1980 [JP] Japan ..... 55-128691
Oct. 6, 1980 [JP] Japan ..... 55-140196

[51] Int. Cl.[3] ..... B41J 7/92
[52] U.S. Cl. ..... 101/93.03; 400/157.3
[58] Field of Search ..... 101/93.05, 99.29, 93.34, 101/93.48; 400/166, 157.3

[56] References Cited

U.S. PATENT DOCUMENTS

| | | | |
|---|---|---|---|
| 4,189,246 | 2/1980 | Kane et al. | 101/93.03 X |
| 4,262,592 | 4/1981 | Araki | 400/157.3 X |
| 4,278,021 | 7/1981 | Nakano et al. | 101/93.03 X |
| 4,280,404 | 7/1981 | Barrus et al. | 101/93.03 |
| 4,293,888 | 10/1981 | McCarty | 400/166 X |

FOREIGN PATENT DOCUMENTS

| | | | |
|---|---|---|---|
| 1436992 | 5/1976 | United Kingdom | 101/93.03 |

*Primary Examiner*—Edward M. Coven
*Attorney, Agent, or Firm*—Pollock, Vande Sande & Priddy

[57] ABSTRACT

In a high speed impact printer of the type arranged to impact a plurality of print hammers against given types carried by a type carrier by energizing corresponding solenoids, the energization of given solenoid or solenoids is started from a given point of time. The given solenoid(s) is/are continuously energized for a predetermined interval which is accurately determined by digital circuitry having a counter. A memory for storing data each indicative of a place in a print line in each address thereof, is provided, where a given address of the memory is periodically read and written at a given interval in response to the output signal of the counter which periodically counts the number of clock pulses. The data stored in the memory is decoded to terminate the energization of the given solenoid(s). The device according to the invention may be applied to a printer of the type arranged to drive each print hammer one after another in a sequence from the first place to the last place of a print line, and also to a printer of the type arranged to drive one or more print hammers simultaneously.

26 Claims, 11 Drawing Figures

DEVICE FOR CONTROLLING SOLENOIDS OF HIGH SPEED PRINTER

BACKGROUND OF THE INVENTION

This invention relates generally to high speed printers, such as impact line printers, of the type arranged to drive print hammers by means of solenoids, and more particularly, the present invention relates to a device for accurately controlling the energizing interval of respective solenoids of such a printer.

As is well known, there are two sorts or types of impact line printers, namely, back impact type and front impact type, and the present invention may be applicable to both of these types.

High speed impact printers comprise a type carrier in the form of a drum or a looped belt for carrying a plurality of types which will be selectively impacted by the print hammers. Although the present invention may be adapted to both types of printers having a type drum or type belt, the following description will be made in connection with a printer having a type drum. High speed impact printers are further divided into two sorts. In a first sort, each print hammer is independently driven to impact each type on the type drum or belt one after another in a given sequence from the first place to the last place in a print line. In a second sort, one or more print hammers is/are driven simultaneously to impact one or more types on the type drum or belt at the same time. In both the first and second sorts, scanning is performed to check the relationship between print data indicative of each character to be printed in a single line and character codes indicative of characters on the type drum or belt. In the first sort, each print hammer is driven one after another to complete printing of a single line, while in the second sort, one or more print hammers is/are driven simultaneously once a scanning. As will be understood from the following description, the present invention may be adapted to these first and second sorts of high speed impact printers.

In back impact type line printers, a type carrier, such as a type belt or a type drum, arranged to pass a printing position, and a plurality of print hammers arranged along the print positions, facing the type carrier, are provided so that printing is effected by copying respective characters of type faces on a print sheet passing between the type carrier and the print hammer by means of an ink ribbon or the like. Each of the print hammers must be driven for a given period of time for performing desirable printing and for preventing ghosting, smudging or misregistration of printed characters.

The plurality of the print hammers are respectively driven by solenoids which are arranged to be energized by switching elements, such as power transistors. Therefore, in order that each print hammer is driven for a given period of time, it is necessary to continuously operate a corresponding switching element for a predetermined period of time.

To this end, up to this time, a monostable multivibrator has been used generally for energizing each solenoid for a given period of time. As is well known, the output pulse width of a monostable multivibrator is determined by the time constant which is defined by the resistance of a resistor and the capacitance of a capacitor. However, the resistance and the capacitance have relatively wide variation ranges. Accordingly, the above-mentioned energizing interval can be accurately controlled only when the resistance of a variable resistor is manually adjusted. However, since the number of circuits, whose time constant must be adjusted in the above-mentioned manner, generally corresponds to the number of places of characters in one print line, the number is very large, for instance 132. For this reason, it has been time consuming to effect such adjustment of time constants of monostable multivibrators. Furthermore, capacitors have a large variation range against temperature changes, and therefore, the pulse widths of such monostable multivibrators have been affected by temperature changes.

According to another already proposed method for controlling the energizing interval to a given value, scanning interval or type travelling time, i.e. the interval between adjacent characters, is utilized, where the scanning interval is a period of time for which the contents of a line print buffer storing print data of one line is compared with the contents of a character code generator generating codes of characters of the type carrier which faces each printing place.

In this method, however, there is a problem that the structure of a control circuit is complex in the case that the energizing interval of each solenoid is not an integral multiple of the scanning interval or the interval between characters, while such a problem does not occur if the energizing interval is set to an integral multiple of the same. Furthermore, since the scanning interval as well as the interval between adjacent characters changes in accordance with the speed variation of the type carrier, poor printing, such as partial printing of a character or misregistration of a character cannot be avoided when the moving speed of the type carrier changes.

SUMMARY OF THE INVENTION

The present invention has been developed in order to remove the above-mentioned various disadvantages and drawbacks inherent to the conventional control device for printer solenoids.

It is, therefore, a primary object of the present invention to provide a new and useful device for controlling energizing interval of high speed printer solenoids so that each solenoid is being energized for a predetermined period of time irrespectively of the scanning interval, the interval between adjacent characters, the movement speed of the type carrier or the ambient temperature.

Another object of the present invention is to provide such a device, which is simple in construction, low in cost and accurate in operation.

According to the present invention information indicative of the printing place in a hammer array, to which driving instruction has been directed, is stored in an address memory means, which is read and written at a given interval. The same address of the address memory means is periodically read out to terminate the energization of the corresponding solenoid. Therefore, the energizing interval of each solenoid is always constant.

As a result, the energizing interval, i.e. the driving interval THD of each print hammer, is given by:

$$THD = N \cdot 0$$

wherein "N" is the number of addresses used in the above-mentioned address storing means; and "t0" is the above-mentioned given interval for writing and reading in and from a given address of the storing means.

From the above-formula, it will be understood that the energizing interval THD is constant without being affected by the scanning interval.

In accordance with the present invention there is provided a device for controlling energizing interval of solenoids of a high speed impact printer of the type arranged to drive print hammers by energizing corresponding solenoids in accordance with the relationship between print data and information indicative of the position of each character on a type carrier, comprising: (a) first means for detecting whether or not each datum of the print data for each place of a print line coincides with each character code of the information; (b) second means responsive to the first means for energizing a solenoid of a given place of the print line when the datum of the given place coincides with one of the character codes; (c) third means responsive to the first means for storing information indicative of the given place which information is derived from the first means; (d) fourth means for reading and writing the third means in such a manner that a given address of the third means is read and written at a given interval; (e) fifth means for decoding information read out from the third means; and (f) sixth means responsive to the fifth means for deenergizing the solenoid whose place is indicated by the output data of the fifth means.

In accordance with the present invention there is also provided a device for controlling energizing interval of solenoids of a high speed impact printer of the type arranged to drive print hammers by energizing corresponding solenoids in accordance with the relationship between print data and information indicative of the position of each character on a type carrier, comprising: (a) first means for detecting whether or not each datum of the print data for each place of a print line coincides with each character code of the information; (b) second means for producing a fire signal when the detection in the first means as far as a given place is terminated; (c) third means for energizing one or more solenoids of given place or places in the print line, which given place or places corresponds to coincided places, in response to the fire signal; (d) fourth means for generating fire data indicative of the occurrence of the fire signal; (e) fifth means responsive to the first means for storing information indicative of the given place or places, which information is derived from the first means; (f) sixth means for reading and writing the fifth means in such a manner that a given address of the fifth means is read and written at a given interval; (g) seventh means for decoding information read out from the fifth means; and (h) eighth means responsive to the seventh means for deenergizing the solenoid or solenoids, whose place or places is/are indicated by the output signal of the first means, when the fire data is read out.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like numerals throughout the drawings.

DETAILED DESCRIPTION OF THE PREFERRED EMBODIMENTS

Figure 1:
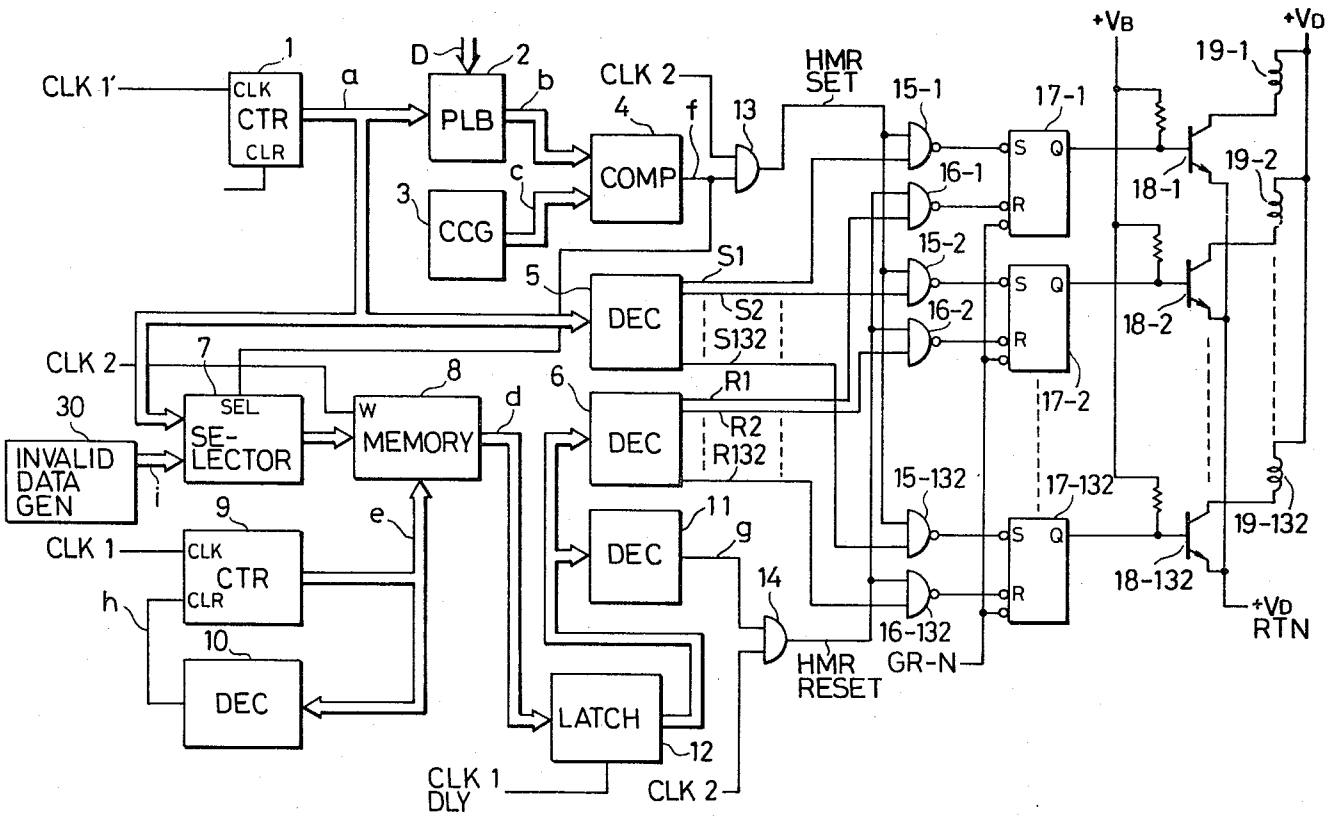
FIG. 1 is a block diagram of a first embodiment of the device according to the present invention.

Referring now to FIG. 1, a block diagram of a first embodiment of the device according to the present invention is shown. It is assumed that the first embodiment device as well as following embodiments of the present invention is applied to a line printer having 132 print hammers. Namely, the maximum number of characters to be printed on one print line is 132. Accordingly, the same number of solenoids 19-1, 19-2 . . . 19-132 are provided to respectively drive the print hammers which are not shown for simplicity. The printer comprises a type carrier (not shown) having a plurality of character marks arranged to move therewith. The printer also comprises a circuit for detecting the presence of each of the character marks in the same manner as in conventional printers of this sort. The detecting circuit is also not shown for simplicity.

Figure 2:
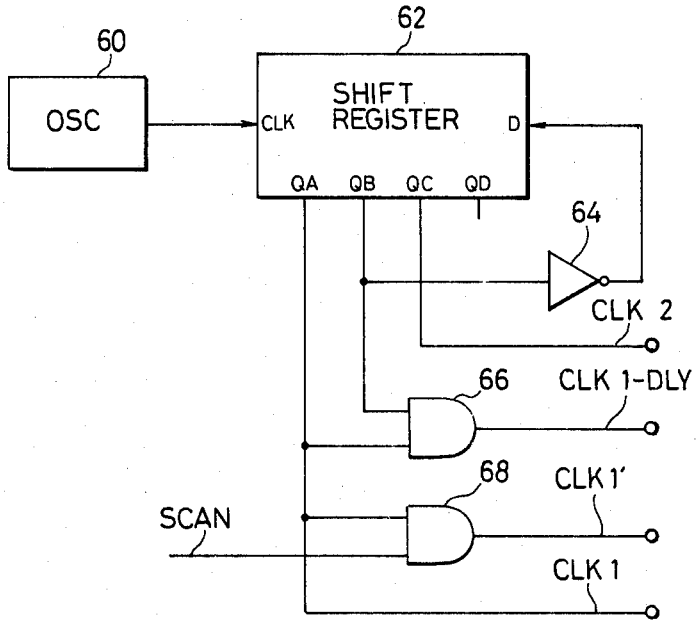
FIG. 2 is a block diagram of a clock pulse generating circuit used in the device according to the present invention.
Figure 3:
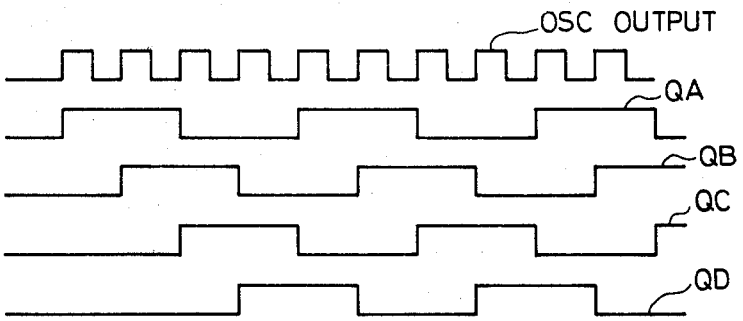
FIG. 3 is a timing chart showing the operation of the clock pulse generating circuit of FIG. 2.

The device of FIG. 1 is responsive to four clock pulse train signals CLK1, CLK2, CLK1', and CLK1-DLY. The references CLK1 and CLK2 are regular interval clock pulse trains, while the clock pulse train CLK1' has the same timing as the clock pulse train CLK1 and is emitted only when scanning operation, which will be described later, takes place. The clock pulse train CLK1-DLY is a train of pulses which become logic "1" a given interval after the clock pulse train CLK1 becomes logic "1", and becomes logic "0" simultaneously with the clock pulse train CLK1. These four clock pulses will be simply referred to as CLK1, CLK2, CLK1' and CLK1-DLY hereafter. These four clock pulse trains may be produced by a clock pulse generating circuit of FIG. 2, having an oscillator 60, a shift register 62, an inverter 64 and two AND gates 66 and 68. FIG. 3 shows a timing chart useful for understanding the operation of the clock pulse generating circuit of FIG. 2. In FIG. 2, the reference SCAN indicates a scan control signal which may be produced in the conventional manner, and this scan control signal will be used to control scanning as will be described hereinlater.

Figure 4:
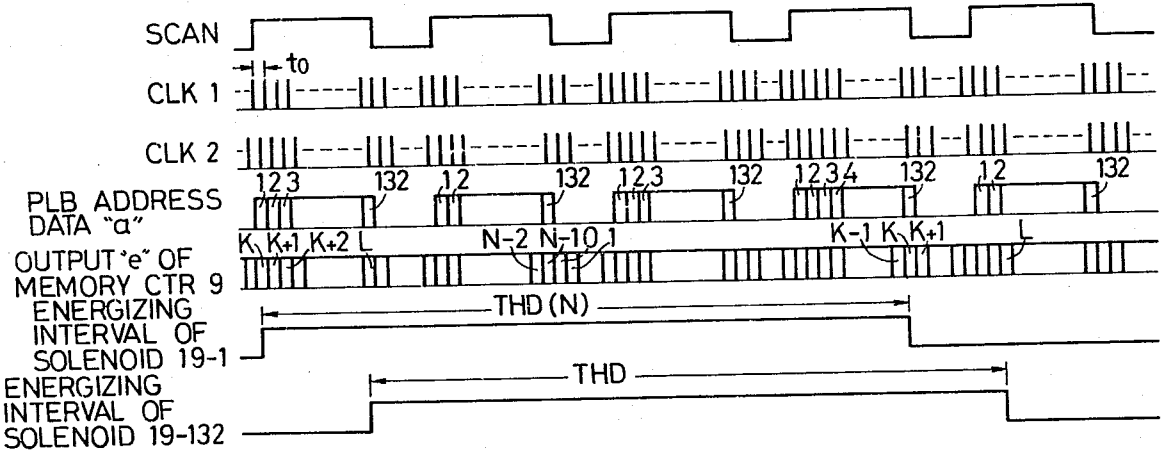
FIG. 4 is a timing chart useful for understanding the operation of the first embodiment device of FIG. 1.

FIG. 4 is a timing chart useful for understanding the operation of the first embodiment of FIG. 1. The device of FIG. 1 is also responsive to print data "D" which is fed from a print data source such as a central processing unit (not shown). The print data "D" is transferred from the print data source to a memory 2, which is referred to as a print line buffer (PLB). The PLB 2 comprises 132 addresses, and the addresses thereof are designated by PLB address data "a" from a PLB address counter 1 which is responsive to CLK1'. Namely, print data "D" for one print line is stored in the PLB 2 in such a manner that each datum indicative of a character is stored in each address. After the transfer of the print data "D", print cycle takes place.

In the print cycle, the aforementioned character mark of the type carrier is detected to actuate a character code generator (CCG) 3 in which codes "c" of characters of the types on the type carrier have been stored, to emit them in a sequence. A piece of data "b" corresponding to one place or position in a print line is emitted from the PLB 2 to be fed to a first input terminal of a digital comparator 4, while one of the the character codes "c" each indicative of each character is applied from the CCG 3 to the second input terminal of the comparator 4. Thus, the print data "b" and the character code "c" are compared with each other to see if there is coincidence or not. This comparison operation is effected in connection with 132 places of a single print line, and the comparison operation for all the places of a single print line is usually referred to as scanning. When performing scanning, the contents of the address counter 1 is counted up by one in response to each pulse of the clock pulse train CLK1' so that the PLB address data "a", i.e. the output of the address counter 1, designates each address of the PLB 2 from the first place to the 132nd place of the print line in a sequence. Namely, 132 pieces of print data "b" are successively read out and are fed to the comparator 4.

The address counter 1 has a clear terminal CLR responsive to a signal for clearing the contents of the address counter 1 prior to each scanning. Therefore, the PLB address data "a" from the address counter 1 starts designating from the first place each time. On the other hand, from the CCG 3 are read out the character codes "c" respectively corresponding to each place of one line in a sequence. Since the way of reading the character codes "c" from the CCG 3 is well known, and since it is out of the feature of the present invention, further description thereof is omitted.

The digital comparator 4 produces, as a result of comparison between the print data "b" from PLB 2 and the character codes "c" from the CCG 3, an output signal "f" of logic "1" in the case of coincidence, and of logic "0" in the case of uncoincidence. This output signal is referred to as a coincidence signal "f", and is fed to an AND gate 13. When the coincidence signal "f" is of logic "1", the AND gate 13, which is responsive to the CLK2, opens its gate at a timing that CLK2 becomes logic "1". As a result, the output signal of the AND gate 13 becomes logic "1", and this signal from the AND gate 13 is referred to as a hammer (HMR) set signal.

A hammer set address decoder 5 is responsive to the PLB address data "a" from the PLB address counter 1 to decoder the PLB address data "a". The decoder 5 has 132 output terminals to derive signals S1 to S132 in accordance with the results of decoding. Namely, one of the 132 output signals S1 to S132, which corresponds to the place represented by the PLB address data "a", becomes logic "1". The above-mentioned hammer set signal from the AND gate 13 is fed to input terminals of 132 NAND gates 15-1 to 15-132, while the signals S1 to S132 are respectively fed to the other input terminal of the same respective NAND gates 15-1 to 15-132. The output terminals of the NAND gates 15-1 to 15-132 are respectively connected to set input terminals "S" of flip-flops 17-1 to 17-132. The reference GR-N is a logic "0" pulse with which the flip-flops 17-1 to 17-132 are reset to an initial state when power is applied to the device. With this arrangement, since all the NAND gates 15-1 to 15-132 are in receipt of the logic "1" hammer set signal from the AND gate 13, one of the NAND gates 15-1 to 15-132, which is corresponding to the place in a print line, opens to cause the corresponding flip-flop 17-X (X indicates one of 1 to 132) to emit a logic "1" output signal. A plurality of (132 in this embodiment) power transistors 18-1 to 18-132 are provided to respectively control the energization of the aforementioned solenoids 19-1 to 19-132. The output terminals "Q" of the flip-flops 17-1 to 17-132 are respectively connected to bases of the power transistors 18-1 to 18-132 respectively. Therefore, the corresponding transistors 18-X becomes conductive in response to the logic "1" signal from the corresponding flip-flop 17-X. Accordingly, an electric current flows through the corresponding solenoid 19-X to drive the corresponding print hammer (not shown).

The solenoid 19-1 is continuously energized until the corresponding flip-flop 17-X is reset in response to a signal from a corresponding NAND gate 16-X to the reset terminal "R" thereof. The NAND gate 16-X is one of the other set of NAND gates 16-1 to 16-132 whose connection and operation will be described hereinlater.

A data selector 7 is provided to select the above-mentioned PLB address data "a" from the PLB address counter 1 or invalid data "i" from an invalid data generator 30. The data selector 7 is responsive to coincidence signal "f" from the comparator 4 so as to select the address data "a" in the case that the coincidence signal "f" is of logic "1" and to select the invalid data "i" in the case that the coincidence signal "f" is of logic "0". Namely, one of the PLB address data "a" and the invalid data "i" is emitted from the selector 7, and is applied to a reset address memory 8. The output data of the selector 7 is written in the memory 8 at a timing that CLK2 becomes logic "1". In detail, the address of the memory 8 is designated by memory address data "e" from a memory counter 9. The above-mentioned invalid data "i" is a data code which will not be emitted as the PLB address data "a".

The above-mentioned memory counter 9 is responsive to CLK1 to count up by one, and is further responsive to an output signal "h" from a clear address decoder 10 which receives the memory address data "e" from the output of the memory counter 9. Namely, the clear address decoder 10 produces a logic "1" signal as the signal "h" when the counted value of the memory counter 9 reaches a given number N. With this arrangement the memory address data "e" from the memory counter 9 circulates, designating from address 0 to address (N−1) in a sequence.

After circulating one cycle, the memory counter 9 redesignates an address in which the PLB address data "a" has been written to read out the PLB address data "a". The read out PLB address data "a" is fed as a signal "d" to a latch 12 to be stored therein at a timing that CLK1-DLY becomes logic "1".

Namely, reading and writing operations of the reset address memory 8 are respectively effected at the timings that CLK1 DLY and CLK2 respectively become logic "1". The output data of the latch 12 is fed to a hammer reset address decoder 6 to be decoded therein. The decoder 6 has 132 output terminals corresponding to respective places of a single print line in the same manner as the hammer set address decoder 5. Thus, one of 132 output signals R1 to R132, which corresponds to a given place, becomes logic "1". A valid address decoder 11 is also responsive to the output data from the latch 12 to see whether the output signal "d" of the reset address memory 8 is the PLB address data "a" or the invalid data "i". Namely, when the latch output data is the PLB address data "a", the valid address decoder 11 produces a logic "1" signal "g" indicative of validity. The output signal "g" of the valid address decoder 11 is referred to as a valid signal, and when the valid signal is of logic "1", an AND gate 14 opens at a timing that CLK2 becomes logic "1" to produce an output signal, which is referred to as a hammer (HMR) reset signal.

The aforementioned other set of NAND gates 16-1 to 16-132 are respectively responsive to the signals R1 to R132 from the hammer reset address decoder 6 and to the hammer reset signal from the AND gate 14. In the presence of the hammer reset signal a given NAND gate 16-X designated by one of the signals R1 to R132 opens to reset the corresponding flip-flop 17-X. Accordingly, the flip-flop 17-X produces a logic "0" output signal in place of a logic "1" signal so that corresponding power transistor 18-X becomes nonconductive. Thus, the corresponding solenoid 19-X is deenergized.

In the above operation, assuming that the period of CLK1 is expressed in terms of t0, the same address of the reset address memory 8 is repeatedly designated at an interval expressed by N·t0. Therefore, if the solenoid energizing interval or print hammer driving interval THD is set to a value which is equal to N·t0, the energizing or driving interval THD becomes always constant.

Figure 5:
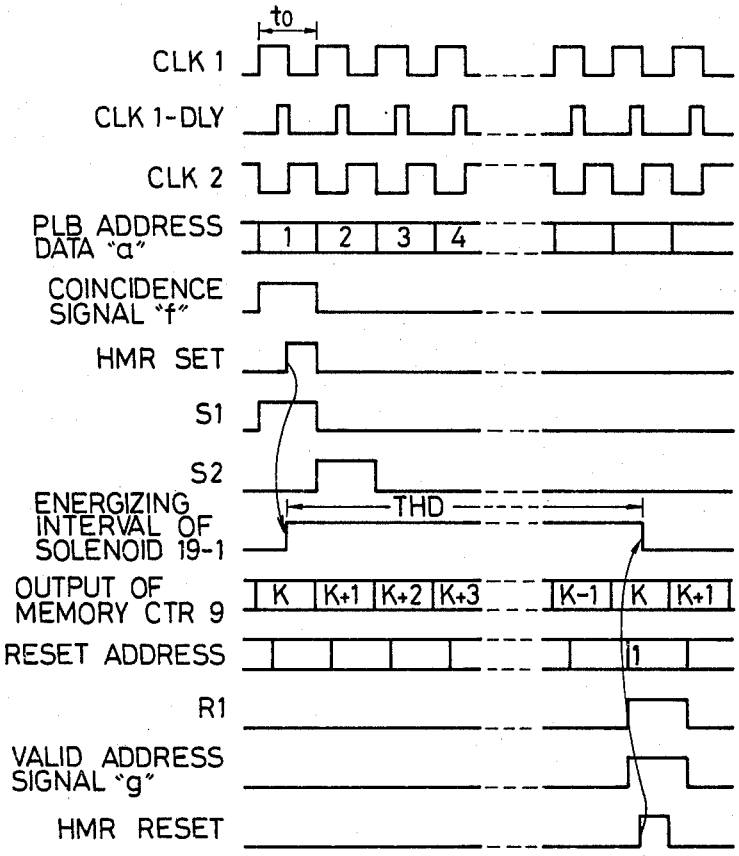
FIG. 5 is a timing chart useful for understanding the operation of the first embodiment device of FIG. 1 in connection with the first place in a print line.

The operation of the first embodiment device of FIG. 1 will be further described in detail with reference to a timing chart of FIG. 5, assuming that the print hammer of the first place of the print line is to be actuated. The scanning operation which starts in response to the detection of the above-mentioned character mark actually starts in synchronism with CLK1, and therefore, the PLB address data "a" and the memory address data "e" are synchronous with each other.

After scanning has started, the PLB address data "a" designates the first place. Print data "b" of the first place and a character code "c" corresponding to the first place are respectively fed from the PLB 2 and the CCG 3 to the comparator 4. When the two data coincide with each other, the comparator 4 emits a logic "1" coincidence signal "f".

Simultaneously, the hammer set address decoder 5 detects that the PLB address data "a" is designating the first place, and thus the signal S1 becomes logic "1". The AND gate 13 responsive to the coincidence signal "f" opens its gate at the timing that CLK2 becomes logic "1" to produce a logic "1" hammer set signal. Accordingly, the following NAND gate 15-1 opens to set the flip-flop 17-1. Thus, the power transistor 18-1 turns on to start energizing the corresponding solenoid 19-1. As a result, the print hammer of the first place starts being driven.

At this time, since the above-mentioned coincidence signal "f" is of logic "1", the data selector 7 selects the PLB address data "a", and then this data "a" is written in the reset address memory 8 at the timing that the CLK2 becomes logic "1". Let us suppose that the memory address data "e" indicates an address "K". In this condition, the PLB address data "a" of the first place is written in an address "K" of the reset address memory 8.

When a subsequent pulse of CLK1 occurs, the PLB address data "a" designates the second place, while the memory address data "e" is added by one to designate an address K+1. The following operation is the same as in the case of the first place. Namely, when the print data "b" coincides with the character code "c", the flip-flop 17-2 is set to turn on the transistor 18-2, and thus the energization of the solenoid 19-2 for the second place print hammer is started. In the case that the two data applied to the comparator 4 do not coincide with each other, the aforementioned invalid data "i" is written in the address K+1 of the reset address memory 8 at the timing of CLK2.

After this, the PLB address data "a" as well as the memory address data "e" is added by one each time a pulse of CLK1 occurs. When the PLB address data "a" designates the address 132 to complete the comparison for the 132nd place, the scanning operation is terminated, and thus no CLK'1 occurs. However, since CLK1 keeps occurring, the memory address data "e" is added by one each time a pulse of CLK1 occurs even thereafter.

When a subsequent character mark is detected, scanning is restarted in synchronism with CLK1 to perform comparison in the same way as in the previous scanning. The memory address data "e" is added by one as described in the above, and the value of this data, i.e. the counted value of the memory counter 9 becomes "N", the contents of the memory counter 9 is cleared by the output signal "h" from the clear address decoder 10. As a result, the memory address data "e" returns to zero.

After this, the same operations are repeated, and when the memory address data "e" becomes "K", the output data "d" of the reset address memory 8 is stored in the latch 12 at the timing that CLK1-DLY becomes logic "1", where the data "d" corresponds to the PLB address data "a" of the first place. The hammer reset address decoder 6 decodes the output data of the latch 12 to cause its one output signal R1 to be of logic "1". Meanwhile, the valid address decoder 11 decodes the same output data of the latch 12 to detect that the data "d" is not the invalid data "i" but is valid, causing the valid signal "g" to become logic "1". Thus, the hammer reset signal, which is the output signal of the AND gate 14, becomes logic "1" at the timing that CLK2 becomes logic "1" to cause the NAND gate 16-1 to open. As a result, the following flip-flop 17-1 is reset to turn off the transistor 18-1, resulting in deenergization of the solenoid 19-1 of the first place print hammer.

From the above, it will be understood that each of the solenoids 19-1 to 19-132 is energized for an interval defined by N·t0. This means that the energizing interval has no relationship with the scanning interval or the interval between characters, while the energizing interval is not affected by the ambient temperature variation or the variation in the moving speed of the type carrier.

The energizing interval of each solenoid 19-1 to 19-132 can be readily changed by changing the value of "N" with which the clear address decoder 10 emits the clear signal "h", namely by changing the number of addresses of the reset address memory 8.

The reset address memory 8 can be initialized as follows. First, the data selector 7 is set so as to select the invalid data "i" to emit the same. Then, the invalid data "i" is written in the reset address memory 8 from the address 0 to the address (N−1) by changing the output signal "e" of the memory counter 9 to designate these addresses in a sequence.

In the above-described first embodiment, although the invalid data "i" is written in corresponding addresses of the reset address memory 8 when the print data "b" does not coincide with the character code "c", the validity of the output data "d" of the reset address memory 8 can be detected without using such invalid data "i".

Figure 6:
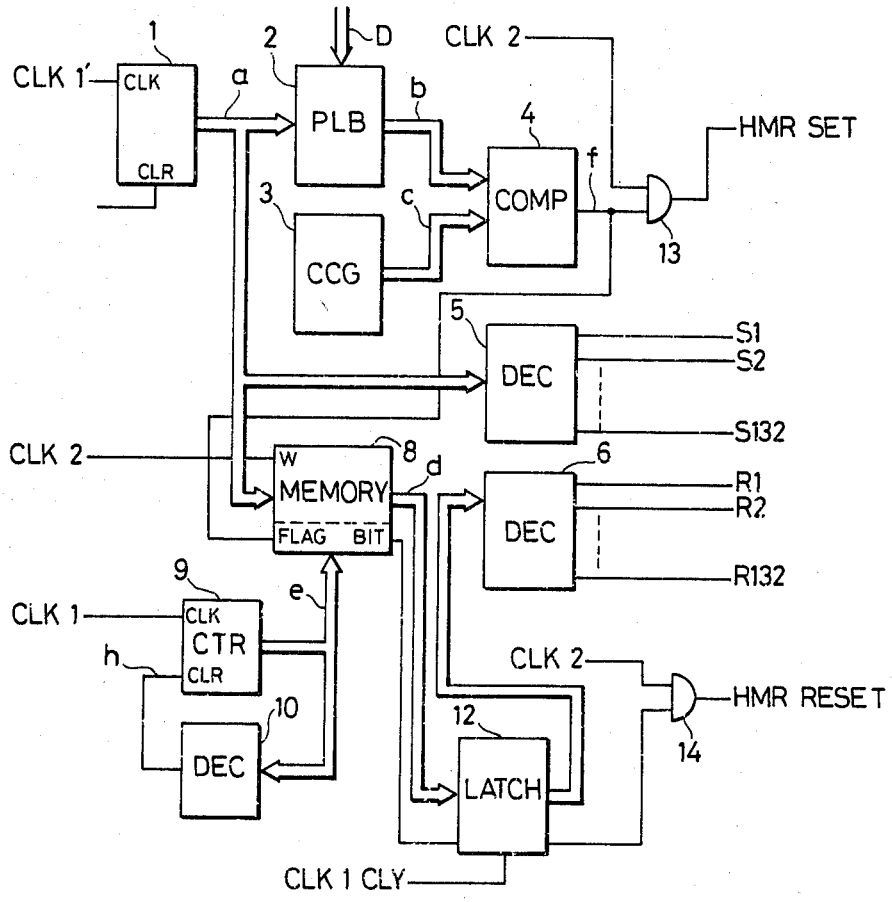
FIG. 6 is a partial block diagram of a second embodiment of the device according to the present invention.

Hence, reference is now made to FIG. 6 which shows a second embodiment device according to the present invention, in which a flag bit is used in place of such invalid data "i". The construction of the second embodiment device is similar to the first embodiment, and therefore, the second embodiment is shown by way of a partial block diagram which shows a portion different from the first embodiment. As shown in FIG. 6, a one-bit storing region is additionally provided to the reset address memory 8 so as to store a flag bit. Namely, the reset address memory 8 used in the second embodiment has first and second regions for respectively storing the PLB address data "a" and the flat bit. The coincidence signal "f" from the comparator 4 is directly applied to the reset address memory 8 in such a manner that a logic "1" is written in the second region as the flag bit when the coincidence signal "f" is of logic "1", and a logic "0" is written when the coincidence signal "f" is of logic "0". In addition, a one-bit storing region is additionally provided to the latch 12 so that the flag bit read out from the reset address memory 8 can be written therein. The output of this one-bit storing region of the latch 12 is connected to the input terminal of the AND gate 14.

With this circuit arrangement, although the signals R1 to R132 from the hammer reset address decoder 6 become logic "1" one after another in such a manner that one of the signals R1 to R132 is of logic "1" at an instant, only a given solenoid 19-X corresponding to a desired place is deenergized because the AND gate 14 selectively opens and closes in accordance with the flag bit from the latch 12.

In the second embodiment device which is of the type using a flag bit, although a one-bit storing region must be added to each of the reset address memory 8 and the latch 12, the second embodiment has an advantage compared to the the first embodiment in that the invalid data generator 30, the data selector 7, and the valid address decoder 11 are unnecessary so that the structure of the whole system is simple.

The above-described first and second embodiments may be adapted to printers which are arranged to effect printing by driving each print hammer in a sequence from the first place to the last place in a single print line. However, the device according to the present invention can also be used for printers of the type arranged to drive one or more print hammers simultaneously.

Figure 7:
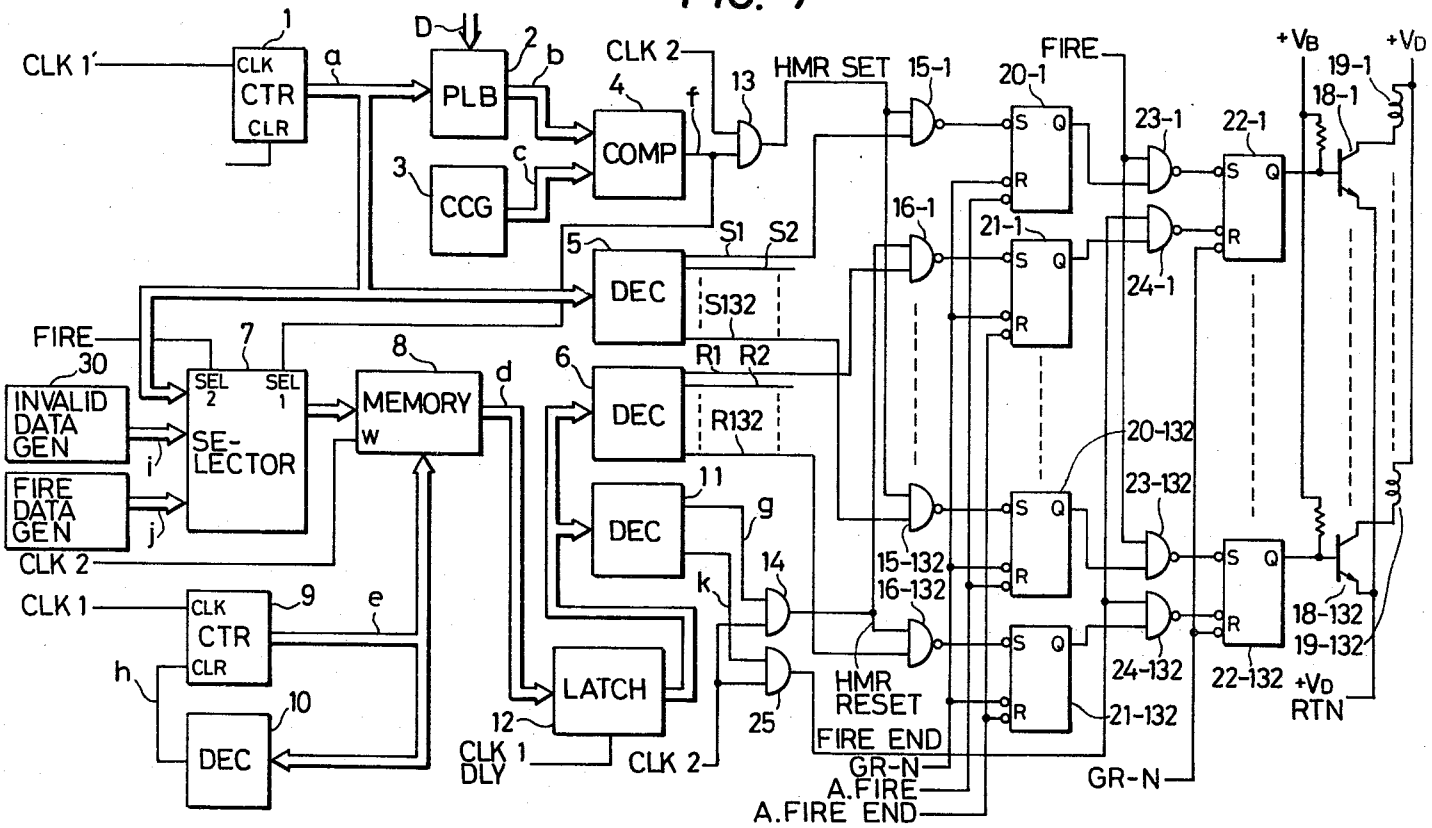
FIG. 7 is a block diagram of a third embodiment of the device according to the present invention.
Figure 8:
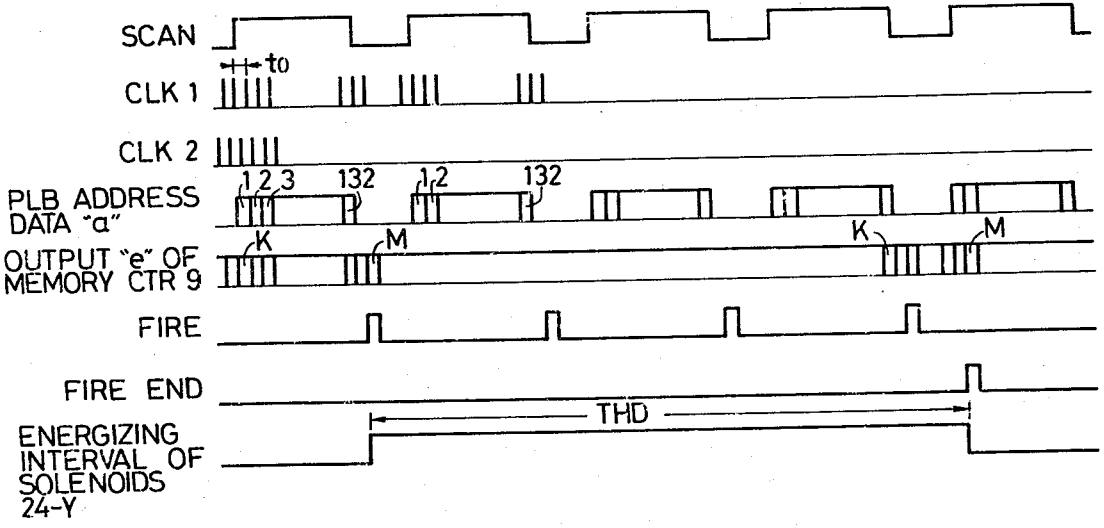
FIG. 8 is a timing chart useful for understanding the operation of the third embodiment device of FIG. 6.

Hence, reference is now made to FIGS. 7 and 8 which respectively illustrate a block diagram and a timing chart of a third embodiment device according to the present invention. The third embodiment is similar to the first embodiment of FIG. 1, and therefore, only different portions will be described. Although the selector 7 of the first embodiment is controlled by only the coincidence signal "f" from the comparator 4, the selector 7 in the third embodiment is controlled not only by the coincidence signal "f" but also by a FIRE signal indicative of the termination of scanning. Furthermore, the selector 7 receives FIRE data "j", which indicates the occurrence of the FIRE signal, in addition to the PLB address data "a" and the invalid data "i". Furthermore, an AND gate 25 is additionally provided in the third embodiment. Moreover, four NAND gates 15-X, 16-X, 23-X, and 24-X and three flip-flops 20-X, 21-X and 22-X are used for each place of the single print line instead of the two NAND gates 15-X and 16-X and the flip-flop 17-X in the first embodiment.

The AND gate 13 responsive to the coincidence signal "f" from the comparator 4 and to CLK2 operates in the same manner as in the first embodiment. Meanwhile the hammer set address decoder 5 operates in the same manner as in the first embodiment. Thus, each of the NAND gates 15-1 to 15-132 operates in the same manner as in the first embodiment. Namely, only one NAND gate 15-X corresponding to a given place of the print line, which place is designated by the PLB address data "a", open to set the corresponding flip-flop 20-X. As a result, the output signal of the flip-flop 20-X assumes logic "1".

The data selector 7 of the third embodiment is provided to select one from three input data, i.e. the above-mentioned PLB address data "a" from the PLB address counter 1, the invalid data "i" from the invalid data generator 30 and the above-mentioned FIRE data "j". The data selector 7 is responsive to the coincidence signal "f" from the comparator 4 and to the FIRE signal so as to select the PLB address data "a" in the case that the coincidence signal "f" is of logic "1" while the FIRE signal is of logic "0", and to select the invalid data "i" in the case that the coincidence signal "f" is of logic "0" while the FIRE signal is also of logic "0". On the other hand, when the FIRE signal is of logic "1", the FIRE data "j" is selected. Namely, one of the PLB address data "a", the invalid data "i" and the FIRE data is emitted from the selector 7, and is applied to the reset address memory 8. The output data of the selector 7 is written in the memory 8 at a timing that CLK2 becomes logic "1" in the same manner as in the first embodiment. In the above, the FIRE data "j" is one which will not be emitted as the PLB address data "a" or the invalid data "i".

After the scanning operation has been completed as far as the 132nd place, the FIRE signal, with which print hammers of the places corresponding to coincided places during scanning are driven by energizing corresponding solenoids, become logic "1". As a result, given NAND gates 23-Y corresponding to flip-flops 20-Y, which store data for coincided places, among the first set of NAND gates 23-1 to 23-132 open to cause corresponding flip-flops 22-Y among the third set of flip-flops 22-1 to 22-132 to be set (wherein "Y" represents one or more of 1 to 132). Thus, the output signals of the selected flip-flops 22-Y become logic "1" to render corresponding transistors 18-Y conductive, energizing corresponding solenoids 19-Y to drive given print hammers. The flip-flops 20-Y are then reset by a logic "0" A. FIRE signal which occurs after the FIRE signal has become logic "0".

At this time, on the other hand, the FIRE data "j" applied through the data selector 7 is written in given addresses of the reset address memory 8, which given addresses are designated by the memory counter 9. The designation of the addresses of the reset address memory 8 is effected in the same manner as in the first embodiment by the reset address memory address "e" from the memory counter 9. The output data "d" of the reset address memory 8 is fed to the latch 12 to be temporarily stored therein, and is then fed to a valid address-/FIRE data decoder 11 and to the hammer reset address decoder 6 in the same manner as in the first embodiment.

The valid address/FIRE data decoder 11 in the third embodiment differs from the valid address decoder 11 of the first embodiment in that it has two output terminals. Namely, the valid address/FIRE data decoder 11 detects which one of the PLB address data "a", the invalid data "i" and the FIRE data "j" is the data "d" from the reset address memory 8. As a result of the decoding, if the data "d" is the PLB address data "a", the valid address signal "g" emitted from the valid address/FIRE data decoder 11 becomes logic "1". The AND gate 14 responsive to the valid address signal "g" and to CLK2 opens its gate when the valid address signal "g" is of logic "1" at the timing that CLK2 becomes logic "1" so that a hammer reset signal is generated. Accordingly, corresponding NAND gates 16-Y among the NAND gates 16-1 to 16-132 open to set corresponding flip-flops 21-Y.

After this, as up counting in the memory counter 8 advances to designate the address, in which the above-mentioned FIRE data "j" has been stored, the FIRE data "j" is stored in the latch 12 at a timing that CLK1-DLY becomes logic "1". In this case, the valid address-/FIRE data decoder 11 detects that the data "d" from the latch 12 is the FIRE data "j" to produce a valid FIRE signal "k" of logic "1". The additionally provided AND gate 25 is responsive to the valid FIRE signal "k" and to CLK2 so as to produce a FIRE END signal. Namely, the AND gate 25 opens its gate at a timing that CLK 2 becomes logic "1" in the presence of the logic "1" valid FIRE signal "k". The FIRE END signal from the AND gate 25 is fed to the NAND gates 24-1 to 24-132, and thus, the gates of corresponding NAND gates 20-Y open to reset given flip-flops 22-Y of corresponding places. Accordingly, corresponding transistors 18-Y are turned off to deenergize corresponding solenoids 19-Y. The flip-flops 21-Y are then reset by a logic "0" A. FIRE END signal which occurs after the FIRE END signal has become logic "0".

In the above operation, assuming that the period of CLK1 is expressed in terms of t0, the same address of the reset address memory 8 is repeatedly designated at an interval expressed by N·t0. Therefore, if the solenoid energizing interval or print hammer driving interval THD is set to a value which is equal to N·t0, the energizing or driving interval THD becomes always constant in the same manner as in the previous embodiments.

Figure 9:
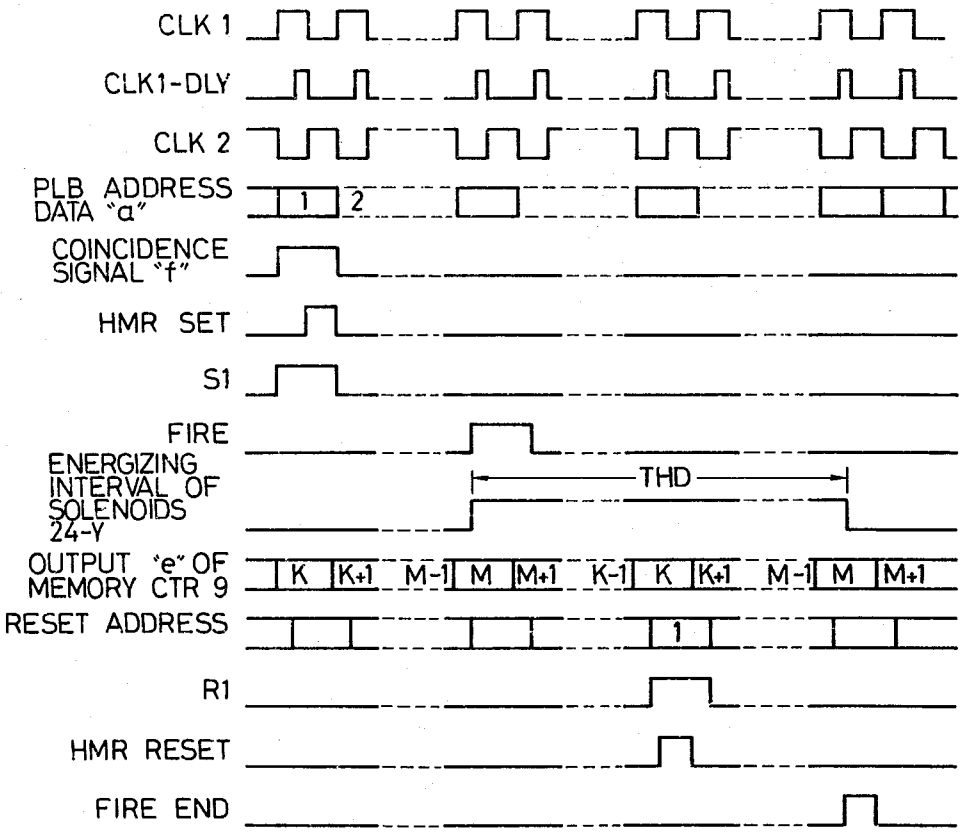
FIG. 9 is a timing chart useful for understanding the operation of the third embodiment device of FIG. 6 in connection with the first place in a print line.

The operation of the third embodiment device of FIG. 7 will be further described in detail with reference to a timing chart of FIG. 9, assuming that the print hammer of the first place of the print line is to be actuated. The scanning operation which starts in response to the detection of the above-mentioned character mark actually starts in synchronism with CLK1, and therefore, the PLB address data "a" and the memory address data "e" are synchronous with each other.

After scanning has started, the PLB address data "a" designates the first place. Print data "b" of the first place and a character code "c" corresponding to the first place are respectively fed from the PLB 2 and the CCG 3 to the comparator 4. When the two data coincide with each other, the comparator 4 emits a logic "1" coincidence signal "f".

Simultaneously, the hammer set address decoder 5 detects that the PLB address data "a" is designating the first place, and thus the signal S1 becomes logic "1". The AND gate 13 responsive to the coincidence signal "f" opens its gate at the timing that CLK2 becomes logic "1" to produce a logic "1" hammer set signal. Accordingly, the followng NAND gate 15-1 opens to set the flip-flop 20-1.

At this time, since the above-mentioned coincidence signal "f" is of logic "1", the data selector 7 selects the PLB address data "a", and then this data "a" is written in the reset address memory 8 at the timing that CLK2 becomes logic "1". Let us suppose that the memory address data "e" indicates an address "K". In this condition, the PLB address data "a" of the first place is written in an address "K" of the reset address memory 8.

When a subsequent pulse of CLK1 occurs, the PLB address data "a" designates the second place, while the memory address data "e" is added by one to designate an address K+1. The following operation is the same as in the case of the first place. Namely, when the print data "b" coincides with the character code "c", the flip-flop 20-2 is set, while the PLB address data "a" corresponding to the second place is written in the address K+1 of the reset address memory 8. In the case that the print data "b" does not coincide with the character code "c", the aforementioned invalid data "i" is written in the address K+1 of the reset address memory 8 at the timing of CLK2.

After this, the PLB address data "a" as well as the memory address data "e" is added by one each time a pulse of CLK1 occurs. When the PLB address data "a" designates the address 132 to complete the comparison for the 132nd place, the scanning operation is terminated, and thus no CLK'1 occurs. However, since CLK1 keeps occurring, the memory address data "e" is added by one each time a pulse of CLK1 occurs even thereafter.

After scanning, the FIRE signal becomes logic "1" to open the NAND gate 23-1. Thus, the flip-flop 22-1 is set to emit a logic "1" output signal. As a result, the transistor 18-1 turns on to start energizing the solenoid 19-1 so that the print hammer of the first place is driven. The flip-flop 20-1 is then reset by the A. FIRE signal.

Since the FIRE signal is of logic "1", the data selector 7 selects the FIRE data "j", and the selected FIRE data "j" is written in the reset address memory 8 at the timing that CLK2 becomes logic "1". At this time, assuming that the memory address data "e" is "M", the FIRE data "j" is written in address M of the reset address memory 8.

When a subsequent character mark is detected, scanning is restarted in synchronism with CLK1 to perform comparison in the same way as in the previous scanning. The memory address data "e" is added by one as described in the above, and the value of this data, i.e. the counted value of the memory counter 9 becomes "N", the contents of the memory counter 9 is cleared by the output signal "h" from the clear address decoder 10. As a result, the memory address data "e" returns to zero.

After this, the same operations are repeated, and when the memory address data "e" becomes "K", the output data "d" of the of the reset address memory 8 is stored in the latch 12 at the timing that CLK1-DLY becomes logic "1", where the data "d" corresponds to the PLB address data "a" of the first place. The hammer reset address decoder 6 decodes the output data of the latch 12 to cause its one output signal R1 to be of logic "1". Meanwhile, the valid address/FIRE data decoder 11 decodes the same output data of the latch 12 to detect that the data "d" is not the invalid data "i" but is valid, causing the valid signal "g" to become logic "1". Thus, the hammer reset signal, which is the outut signal of the AND gate 14, becomes logic "1" at the timing that CLK2 becomes logic "1" to cause the NAND gate 16-1 to open. As a result, the following flip-flop 21-1 is set.

When the memory address data "e" assumes "M", the FIRE data "j" is read out from the reset address memory 8, and is stored in the latch 12 at the timing that CLK1-DLY becomes logic "1". The valid address-/FIRE data decoder 11 decodes the read out FIRE data "j" to produce a logic "1" valid FIRE signal "k". Thus, the AND gate 25 opens at the timing that CLK2 becomes logic "1" to produce a logic "1" FIRE END signal. Accordingly, the NAND gate 24-1 opens to reset the flip-flop 22-1, causing the transistor 18-1 to turn off. As a result the corresponding solenoid 19-1 is deenergized. The flip-flop 21-1 is then reset by the A. FIRE END signal.

From the above, it will be understood that each of the solenoids 19-1 to 19-132 is being energized for an interval defined by N·t0. This means that the energizing interval has no relationship with the scanning interval or the interval between characters, while the energizing interval is not affected by the ambient temperature variation or the variation in the moving speed of the type carrier.

The energizing interval of each solenoid 19-1 to 19-132 can be readily changed by changing the value of "N" with which the clear address decoder 10 emits the clear signal "h", namely by changing the number of addresses of the reset address memory 8.

The reset address memory 8 can be initialized as follows. First, the data selector 7 is set so as to select the invalid data "i" to emit the same. Then, the invalid data "i" is written in the reset address memory 8 from the address 0 to the address (N−1) by changing the output signal "e" of the memory counter 9 to designate these addresses in a sequence.

In the above-described third embodiment, although the invalid data "i" is written in corresponding addresses of the reset address memory 8 when the print data "b" does not coincide with any of the character codes "c", the validity of the output data "d" of the reset address memory 8 can be detected without using such invalid data "i".

Figure 10:
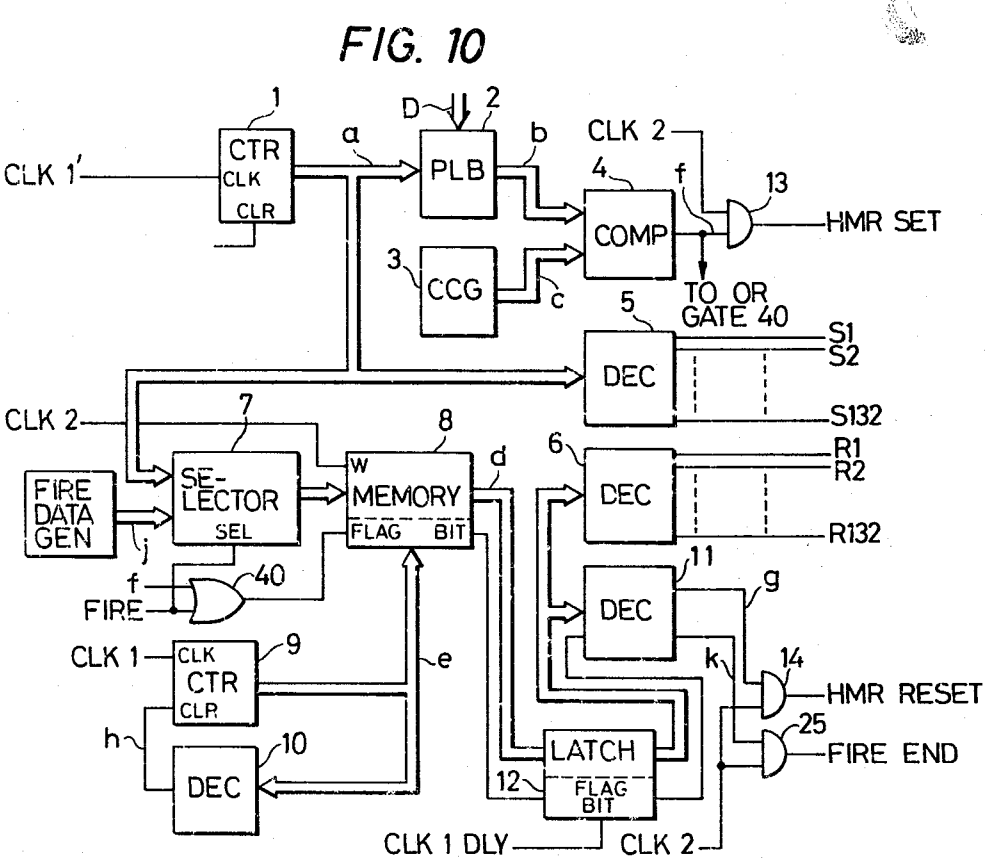
FIG. 10 is a partial block diagram of a fourth embodiment of the device according to the present invention.

Hence, reference is now made to FIG. 10 which shows a fourth embodiment device according to the present invention, in which a flag bit is used in place of such invalid data "i". The construction of the fourth embodiment device is similar to the third embodiment, and therefore, the fourth embodient is shown by way of a partial block diagram which shows a portion different from the third embodiment. As shown in FIG. 10, a one-bit storing region is additionally provided to the reset address memory 8 so as to store a flag bit, while an OR gate 40 is additionally provided to produce the flag bit. The OR gate 40 is responsive to the coincidence signal "f" from the comparator 4 and to the FIRE signal so that a logic "1" is written in the reset address memory 8 when the coincidence signal "f" or the FIRE signal is of logic "1", and a logic "0" is written when both the coincidence signal "f" and the FIRE signal are of logic "0". In addition, a one-bit storing region is additionally provided to the latch 12 so that the flag bit read out from the reset address memory 8 can be written therein. The output of this one-bit storing region of the latch 12 is connected to the valid address/FIRE data decoder 11 which is connected to the AND gate 25 in the same manner as in the third embodiment. The valid address/FIRE data decoder 11 detects whether the flag bit is of logic "1" or "0" to see whether the output data "d" of the reset address memory 8 is valid or not.

Figure 11:
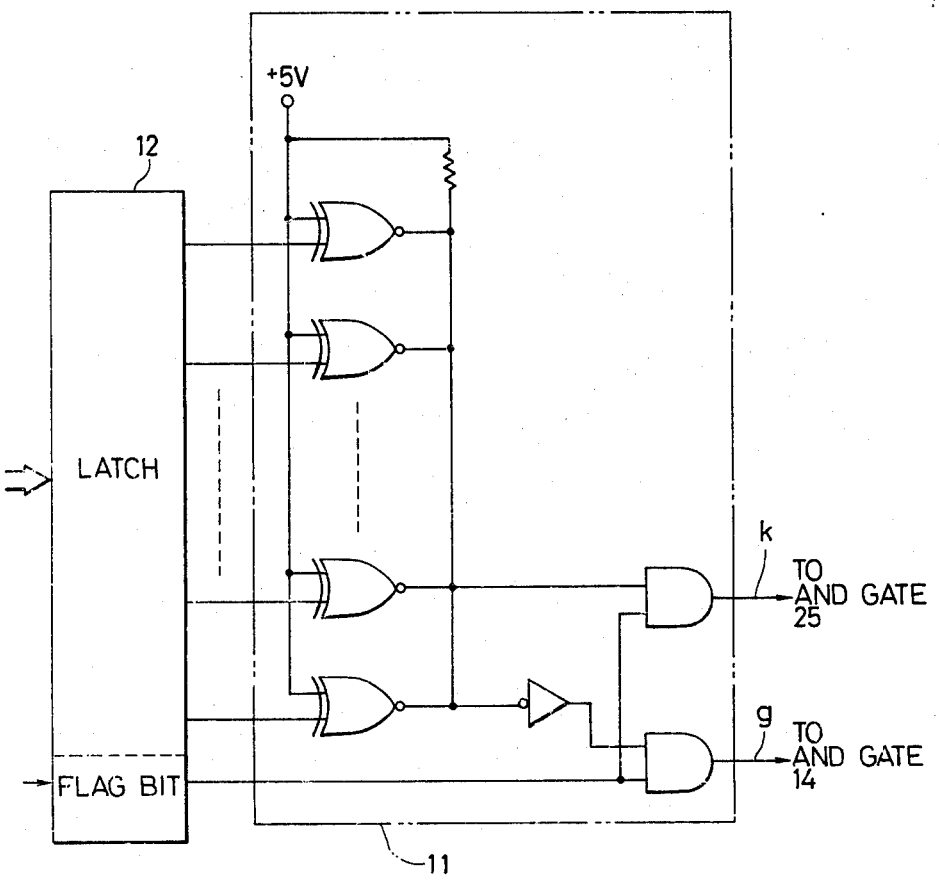
FIG. 11 is a circuit diagram of a valid address FIRE/-date decoder of FIG. 10.

FIG. 11 shows a circuit diagram of the valid address-/FIRE data decoder 11 of FIG. 10. The decoder 11 is responsive to two kinds of information, i.e. the data "d" and the flag bit, from the latch 12, and produces a valid address signal "g" when the flag bit is of logic "1" and the data "d" is address information. On the other hand, when the data "d" is the FIRE data "j" and the flag bit is of logic "1", a valid FIRE signal "k" is produced. When the flag biit is of logic "0", no output is produced from the decoder 11.

With this circuit arrangement, although the signals R1 to R132 from the hammer reset address decoder 6 become logic "1" one after another in such a manner that one of the signals R1 to R132 is of logic "1" at an instant, only a given flip-flop 21-X corresponding to a desired place can be set because the AND gate 14 selectively opens and closes in accordance with the valid address signal "g" so as to produce the hammer reset signal of logic "1" or "0".

In the fourth embodiment device which is of the type using a flag bit, although a one-bit storing region must be added to each of the reset address memory 8 and to the latch 12, the fourth embodiment has an advantage compared to the third embodiment in that the invalid data generator 30, the data selector 7, and the valid address/FIRE data decoder 11 are unnecessary so that the structure of the whole system is simple.

The above-described embodiments are just examples of the present invention, and therefore, it will be apparent for those skilled in the art that many modifications and variations may be made without departing from the spirit of the present invention.

What is claimed is:

1. A device for controlling energizing interval of solenoids of a high speed impact printer of the type arranged to drive print hammers by energizing corresponding solenoids in accordance with the relationship between print data and information indicative of the position of each character on a type carrier, comprising:

(a) first means for detecting whether or not each datum of said print data for each place of a print line coincides with each character code of said information;

(b) second means responsive to said first means for energizing a solenoid of a given place of said print line when said datum of said given place coincides with one of said character codes;

(c) third means responsive to said first means for storing information indicative of said given place which information is derived from said first means;

(d) fourth means for reading and writing said third means in such a manner that a given address of said third means is read and written at a given interval;

(e) fifth means for decoding information read out from said third means; and (f) sixth means responsive to said fifth means for deenergizing said solenoid whose place is indicated by the output data of said fifth means.

2. A device as claimed in claim 1, wherein said first means comprises an address counter responsive to a clock pulse train, a print line buffer for storing said print data of one print line in addresses designated by the output data of said address counter, a character code generator for producing character codes in response to the detection of each character mark moving with said type carrier, and a digital comparator responsive to the output data of said print line buffer and said character code generator.

3. A device as claimed in claim 2, wherein said third means comprises a memory having a first region for storing the output data of said address counter, indicating said given place in said print line, and a second region for storing the output signal of said digital comparator, indicating coincidence between said print data and said character code.

4. A device as claimed in claim 3, wherein said fifth means comprises a latch having a first region for temporarily storing a first data from said first region of said memory and a second region for temporarily storing a second data from said second region of said memory; a decoder for detecting the place of said solenoid to be deenergized by decoding said first data from said latch, and a gate circuit responsive to a clock pulse train and to said second data from said latch.

5. A device as claimed in claim 2, wherein said second means comprises a gate circuit responsive to a clock pulse train and to the output signal of said digital comparator, a decoder responsive to the output data of said address counter for producing a plurality of output signals, a plurality of gate circuits each responsive to the output signal of said gate circuit and to each output signal of said decoder, a plurality of flip-flops responsive to each of said plurality of gate circuits, and a plurality of switching circuits respectively responsive to said plurality of flip-flops.

6. A device as claimed in claim 2, wherein said third means comprises an invalid data generator for generating a given code, a selector responsive to the output signal of said digital comparator for selectively transmitting one of said output data of said address counter and said given code from said invalid data generator, and a memory for storing the output data of said selector.

7. A device as claimed in claim 1, wherein said fourth means comprises a counter responsive to a clock pulse train and a decoder responsive to the output data of said counter for periodically clearing said counter.

8. A device as claimed in claim 1, wherein said fifth means comprises a latch for temporarily storing the output data of said third means, a first decoder for detecting the place of said solenoid to be deenergized by decoding said output data of said third means, a second decoder for detecting whether or not said data from said third means indicates a character, and a gate circuit responsive to a clock pulse train and to the output signal of said second decoder.

9. A device as claimed in claim 8, wherein said sixth means comprises a plurality of gate circuits each responsive to each output of said first decoder and to the output of said gate circuit.

10. A device for controlling energizing interval of solenoids of a high speed impact printer of the type arranged to drive print hammers by energizing corresponding solenoids in accordance with the relationship between print data and information indicative of the position of each character on a type carrier, comprising:

(a) first means for detecting whether or not each datum of said print data for each place of a print line coincides with each character code of said information;

(b) means responsive to said first means for producing a fire signal indicating that said first means has completed detection throughout a single print line;

(c) second means responsive to said first means and to said fire signal for energizing one or more solenoids whose places in said print line have been detected as coincided places by said first means, in response to said fire signal;

(d) means responsive to the fire signal producing means for generating fire data indicative of the occurrence of said fire signal;

(e) third means responsive to said first means for storing information indicative of the coincided places in corresponding addresses thereof and said fire data in an address which is accessed at an instant of the presence of said fire data;

(f) fourth means for reading and writing said third means in such a manner that a given address of said third means is read and written at a given interval;

(g) fifth means for decoding information read out from said third means; and (h) sixth means responsive to said fifth means for deenergizing said solenoid or solenoids, whose places are indicated by the output signal of said first means, when said fire data is read out.

11. A device as claimed in claim 10, wherein said first means comprises an address counter responsive to a clock pulse train, a print line buffer for storing said print data of one print line in addresses designated by the output data of said address counter, a character code generator for producing character codes in response to the detection of each character mark provided to said type carrier, and a digital comparator responsive to the output data of said print line buffer and said character code generator.

12. A device as claimed in claim 11, wherein said third means comprises a selector responsive to said fire signal for selectively transmitting one of the output data of said address counter and said fire data; a gate circuit responsive to said output signal of said digital comparator and to said fire signal; and a memory having a first region for storing the output data of said selector and a second region for storing the output data of said gate circuit.

13. A device as claimed in claim 12, wherein said fifth means comprises a latch having a first region for temporarily storing a first data from said first region of said memory and a second region for temporarily storing a second data from said second region of said memory; a first decoder for detecting the place of said solenoid to be deenergized by decoding said first data of said first region of said latch, a second decoder for detecting whether or not said first data indicates a character by decoding said first and second data of said first and second regions and for detecting whether or not said first data indicates said fire data by decoding said first and second data, a first gate circuit responsive to a clock pulse train and to an output signal of said second decoder, and a second gate circuit responsive to a clock pulse train and to another output signal of said second decoder.

14. A device as claimed in claim 11, wherein said second means comprises a gate circuit responsive to a clock pulse train and to the output data of said digital comparator, a decoder responsive to the output data of said address counter for producing a plurality of output signals, a plurality of first gate circuits each responsive to the output signal of said first-mentioned gate circuit and to each output signal of said decoder, a plurality of first flip-flops responsive to each of said first gate circuits, a plurality of second gate circuits each responsive to each output of said first flip-flops and to said fire signal, a plurality of second flip-flops each responsive to each output of said second gate circuits, and a plurality of switching circuits respectively responsive to said second flip-flops.

15. A device as claimed in claim 11, wherein said third means comprises an invalid data generator for generating a given code, a selector responsive to the output signal of said digital comparator for selectively transmitting one of said output data of said address counter, said given code from said invalid data generator and said fire data from the fire data generating means, and a memory for storing the output data of said selector.

16. A device as claimed in claim 10, wherein said fourth means comprises a counter responsive to a clock pulse train and a decoder responsive to the output data of said counter for periodically clearing said counter.

17. A device as claimed in claim 10, wherein said fifth means comprises a latch for temporarily storing the output data of said third means; a first decoder responsive to the output data of said latch for detecting the place of said solenoid to be deenergized by decoding said output data of said third means; a second decoder responsive to the output data of said latch for producing a first output signal indicating whether or not said data from said third means indicates a character and a second output signal indicating whether or not said data from said third means indicates said fire data; a first gate circuit responsive to a clock pulse train and to said first output signal of said second decoder; and a second gate circuit responsive to a clock pulse train and to said second output signal of said second decoder.

18. A device as claimed in claim 17, wherein said sixth means comprises a plurality of third gate circuits each responsive to each output of said first decoder and to the output of said first gate circuit; a plurality of flip-flops respectively responsive to the outputs of said third gate circuits; and a plurality of fourth gate circuits respectively responsive to the outputs of said flip-flops and to the output of said second gate circuit.

19. A solenoid energizing controlling device for use with a printer having a type carrier arranged to pass a printing position, print hammers for copying the types on said type carriers to a print sheet, solenoids for driving said print hammers, switching means for energizing said solenoids, and comparing means for comparing print data with types on said type carrier for respective print places so as to produce a coincidence signal on coincidence to actuate said switching means, characterized by comprising:

address memory means for storing information indicative of the coincided place of a print hammer when said comparing means generates said coincidence signal; accessing means for accessing the addresses of said address memory means at a given interval so as to access the same address at a given interval; and resetting means for producing a signal, with which the energization of said solenoid of corresponding place is terminated, by decoding information read out from said address memory means.

20. A solenoid energizing controlling device for use with a printer having a type carrier arranged to pass a printing position, print hammers for copying the types on said type carriers to a print sheet, solenoids for driving said print hammers, switching means for energizing said solenoids, and comparing means for comparing print data with types on said type carrier for respective print places so as to produce a coincidence signal for each place on coincidence to actuate said switching means, said printer being arranged such that a fire signal is generated a given period of time after the completion of comparison at a given place, where said fire signal is used to start energizing solenoids of coincided places, characterized by comprising:

a memory means for storing place information indicative of coincided places of said print hammers and fire data indicative of the occurrence of said fire signal into addresses accessed at the time of occurrence of said coincidence signal and said fire signal when said coincidence signal and said fire signal have respectively occurred; accessing means for accessing the addresses of said address memory means at a given interval so as to access the same address at a given interval; and resetting means for producing a signal, with which the energization of said solenoids is terminated, when said fire data is read out, said resetting means being responsive to said place information read out from said memory means so as to decode places whose solenoids are to be deenergized.

21. A device for controlling energizing interval of solenoids of a high speed impact printer of the type arranged to drive print hammers by energizing corresponding solenoids in accordance with the relationship between print data and information indicative of the position of each character on a type carrier, comprising:

(a) first means for detecting whether or not each datum of said print data for each place of a print line coincides with each character code of said information, said first means including an address counter responsive to a clock pulse train, a print line buffer for storing said print data of one print line in addresses designated by the output data of said address counter, a character code generator for producing character codes in response to the detection of each character mark moving with said type carrier, and a digital comparator responsive to the output data of said print line buffer and said character code generator;

(b) second means responsive to said first means for energizing a solenoid of a given place of said print line when said datum of said given place coincides with one of said character codes;

(c) third means responsive to said first means for storing information indicative of said given place which information is derived from said first means, said third means including an invalid data generator for generating a given code, a selector responsive to the output signal of said digital comparator for selectively transmitting one of said output data of said address counter and said given code from said invalid data generator, and a memory for storing the output data of said selector;

(d) fourth means for reading and writing said third means in such a manner that a given address of said third means is read and written at a given interval;
(e) fifth means for decoding information read out from said third means; and
(f) sixth means responsive to said fifth means for deenergizing said solenoid whose place is indicated by the output data of said fifth means.

22. A device for controlling energizing interval of solenoids of a high speed impact printer of the type arranged to drive print hammers by energizing corresponding solenoids in accordance with the relationship between print data and information indicative of the position of each character on a type carrier, comprising:
(a) first means for detecting whether or not each datum of said print data for each place of a print line coincides with each character code of said information;
(b) second means responsive to said first means for energizing a solenoid of a given place of said print line when said datum of said given place coincides with one of said character codes;
(c) third means responsive to said first means for storing information indicative of said given place which information is derived from said first means;
(d) fourth means for reading and writing said third means in such a manner that a given address of said third means is read and written at a given interval;
(e) fifth means for decoding information read out from said third means, said fifth means including a latch for temporarily storing the output data of said third means, a first decoder for detecting the place of said solenoid to be deenergized by decoding said output data of said third means, a second decoder for detecting whether or not said data from said third means indicates a character, and a gate circuit responsive to a clock pulse train and to the output signal of said second decoder; and
(f) sixth means responsive to said fifth means for deenergizing said solenoid whose place is indicated by the output data of said fifth means.

23. A device as claimed in claim 22, wherein said sixth means comprises a plurality of gate circuits each responsive to each output of said first decoder and to the output of said gate circuit.

24. A device for controlling energizing interval of solenoids of a high speed impact printer of the type arranged to drive print hammers by energizing corresponding solenoids in accordance with the relationship between print data and information indicative of the position of each character on a type carrier, comprising:
(a) first means for detecting whether or not each datum of said print data for each place of a print line coincides with each character code of said information, said first means including an address counter responsive to a clock pulse train, a print line buffer for storing said print data of one print line in addresses designated by the output data of said address counter, a character code generator for producing character codes in response to the detection of each character mark moving with said type carrier, and a digital comparator responsive to the output data of said print line buffer and said character code generator;
(b) means responsive to said first means for producing a fire signal indicating that said first means has completed detection throughout a single print line;
(c) second means responsive to said first means and to said fire signal for energizing one or more solenoid whose places in said print line have been detected as coincided places by said first means, in response to said fire signal;
(d) means responsive to the fire signal producing means for generating fire data indicative of the occurrence of said fire signal;
(e) third means responsive to said first means for storing information indicative of the coincided places in corresponding addresses thereof and said fire data in an address which is accessed at an instant of the presence of said fire data, said third means including an invalid data generator for generating a given code, a selector responsive to the output signal of said digital comparator for selectively transmitting one of said output data of said address counter, said given code from said invalid data generator and said fire data from the fire data generating means, and a memory for storing the output data of said selector;
(f) fourth means for reading and writing said third means in such a manner that a given address of said third means is read and written at a given interval;
(g) fifth means for decoding information read out from said third means; and
(h) sixth means responsive to said fifth means for deenergizing said solenoids whose places are indicated by the output signal of said first means, when said fire data is read out.

25. A device for controlling energizing interval of solenoids of a high speed impact printer of the type arranged to drive print hammers by energizing corresponding solenoids in accordance with the relationship between print data and information indicative of the position of each character on a type carrier, comprising:
(a) first means for detecting whether or not each datum of said print data for each place of a print line coincides with each character code of said information;
(b) means responsive to said first means for producing a fire signal indicative that said first means has completed detection throughout a single print line;
(c) second means responsive to said first means and to said fire signal for energizing one or more solenoid whose places in said print line have been detected as coincided places by said first means, in response to said fire signal;
(d) means responsive to the fire signal producing means for generating fire data indicative of the occurrence of said fire signal;
(e) third means responsive to said first means for storing information indicative of the coincided places in corresponding addresses thereof and said fire data in an address which is accessed at an instant of the presence of said fire data;
(f) fourth means for reading and writing said third means in such a manner that a given address of said third means is read and written at a given interval;
(g) fifth means for decoding information read out from said third means, said fifth means including a latch for temporarily storing the output data of said third means, a first decoder responsive to the output data of said latch for detecting the place of said solenoid to be deenergized by decoding said output data of said third means, a second decoder responsive to the output data of said latch for producing a first output signal indicating whether or not said data from said third means indicates a character and a second output signal indicating whether or not said data from said third means indicates said fire data; a first gate circuit responsive to a clock pulse train and to said first output signal of said second decoder; and a second gate circuit responsive to a clock pulse train and to said second output signal of said second decoder; and (h) sixth means responsive to said fifth means for deenergizing said solenoids whose places are indicated by the output signal of said first means, when said fire data is read out.

26. A device as claimed in claim 25, wherein said sixth means comprises a plurality of third gate circuits each responsive to each output of said first decoder and to the output of said first gate circuit; a plurality of flip-flops respectively responsive to the outputs of said third gate circuits; and a plurality of fourth gate circuits respectively responsive to the outputs of said flip-flops and to the output of said second gate circuit.

* * * * *